US005577574A

United States Patent [19]

Joseph

[11] Patent Number: 5,577,574

[45] Date of Patent: Nov. 26, 1996

[54] ADJUSTABLE STEPLADDER

[76] Inventor: Michael E. Joseph, 1025 Tippecanoe, C 205, San Bernardino, Calif. 92410

[21] Appl. No.: 339,792

[22] Filed: Nov. 15, 1994

[51] Int. Cl.[6] ..... E06C 1/00

[52] U.S. Cl. ..... 182/180; 182/104; 182/174

[58] Field of Search ..... 182/104, 105, 182/180, 165, 173–176, 25, 26, 178, 46, 151

[56] References Cited

U.S. PATENT DOCUMENTS

| | | | |
|---|---|---|---|
| 1,935,349 | 11/1933 | Breslow | 182/178 X |
| 2,230,015 | 1/1941 | Rich | 182/176 X |
| 3,225,863 | 12/1965 | Ludlow | 182/104 |
| 4,060,150 | 11/1977 | Hughes | 182/178 X |

FOREIGN PATENT DOCUMENTS

| | | | |
|---|---|---|---|
| 1214561 | 4/1960 | France | 182/174 |

*Primary Examiner*—Alvin C. Chin-Shue

[57] ABSTRACT

An adjustable stepladder comprising a front and rear leg assembly, each having a pair of parallel legs with coupling apertures at their upper ends and elastomeric stoppers at their lower ends, the leg assembly having a plurality of steps extending transversely between the legs with ends coupled to the legs at intermediate points along their lengths, each of the steps being fabricated with an elastomeric coating upon their upper surface, each of the legs being fabricated of a plurality of components with apertures and with the components coupled together in telescoping relationship with a locking pin positionable through alignable apertures in the areas of overlap and a spring interior thereof to hold the locking pin in a preset orientation, the areas of separation being provided beneath the lowermost step, above the uppermost step, and at regions between the steps; a coupling plate having a planar upper surface with an elastomeric sheet thereover with downwardly extending plates with apertures, the apertures adapted to be aligned with the apertures at the upper ends of the legs for effecting the pivotal coupling of the legs with respect to each other and the coupling plate; and a pivotable locking bar coupling the front leg assembly with the rear leg assembly, the locking bar having an aperture at one end pivotally couplable to one of the leg assemblies and having a plurality of apertures at the other end selectively couplable to an aperture of the other leg assembly as a function of the angle to be formed by the front leg assembly and rear leg assembly, the coupling bar also including a central pivot point to allow pivoting between the legs.

1 Claim, 4 Drawing Sheets

ADJUSTABLE STEPLADDER

BACKGROUND OF THE INVENTION

1. Field of the Invention

The present invention relates to a new and improved adjustable stepladder and, more particularly, pertains to allowing users to attain access to areas at varying heights while affording the user more safe, stable and comfortable footing.

2. Description of the Prior Art

The use of stepladders of a wide variety of designs and configurations is known in the prior art. More specifically, stepladders of a wide variety of designs and configurations heretofore devised and utilized for the purpose of extending the utility of stepladders through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of stepladders of a wide variety of designs and configurations. By way of example, U.S. Pat. No. 4,039,047 to Larson discloses ladders incorporating retractable ground spikes.

U.S. Pat. No. 4,210,224 to Kummerlin discloses a longitudinally variable ladder.

U.S. Pat. No. 5,060,755 to Bourdages discloses a stepladder foot-platform.

Lastly, U.S. Pat. No. 5,195,610 to Chang discloses a bi-directionally foldable step ladder.

In this respect, the adjustable stepladder according to the present invention substantially departs from the conventional concepts and designs of the prior art, and in doing so provides an apparatus primarily developed for the purpose of allowing users to attain access to areas at varying heights while affording the user more safe, stable and comfortable footing.

Therefore, it can be appreciated that there exists a continuing need for a new and improved adjustable stepladder which can be used for allowing users to attain access to areas at varying heights while affording the user more safe, stable and comfortable footing. In this regard, the present invention substantially fulfills this need.

SUMMARY OF THE INVENTION

In view of the foregoing disadvantages inherent in the known types of stepladders of a wide variety of designs and configurations now present in the prior art, the present invention provides a new and improved adjustable stepladder. As such, the general purpose of the present invention, which will be described subsequently in greater detail, is to provide a new and improved adjustable stepladder and methods which have all the advantages of the prior art and none of the disadvantages.

To attain this, the present invention essentially comprises a new and improved adjustable stepladder comprising, in combination, a front leg assembly having a pair of parallel legs with coupling apertures at their upper ends and elastomeric stoppers at their lower ends, the leg assembly having a plurality of steps extending transversely between the legs with ends coupled to the legs at intermediate points along their lengths, each of the steps being fabricated with an elastomeric coating upon their upper surface for greater comfort and safety of a user, each of the legs being fabricated of a plurality of components with apertures and with the components coupled together in telescoping relationship with a locking pin positionable through alignable apertures in the areas of overlap and a spring interior thereof to hold the locking pin in a preset orientation, the areas of separation being provided beneath the lowermost step, above the uppermost step, and at regions between the steps; a rear leg assembly having a pair of parallel legs with coupling apertures at their upper ends and elastomeric stoppers at their lower ends, the leg assembly having a plurality of steps extending transversely between the legs with ends coupled to the legs at intermediate points along their lengths, each of the steps being fabricated with an elastomeric coating upon their upper surface for greater comfort of a user, each of the legs being fabricated of a plurality of components with apertures and with the components coupled together in telescoping relationship with a locking pin positionable through alignable apertures in the areas of overlap and a spring interior thereof to hold the locking pin in a preset orientation, the areas of separation being provided beneath the lowermost step, above the uppermost step, and at regions between the steps; a coupling plate having a planar upper surface with an elastomeric sheet thereover for improved comfort and safety and with downwardly extending plates with apertures, the apertures adapted to be aligned with the apertures at the upper ends of the legs for effecting the pivotal coupling of the legs with respect to each other and the coupling plate; a pivotable locking bar coupling the front leg assembly with the rear leg assembly, the locking bar having an aperture at one end pivotally couplable to one of the leg assemblies and having a plurality of apertures at the other end selectively couplable to an aperture of the other leg assembly as a function of the angle to be formed by the front leg assembly and rear leg assembly, the coupling bar also including a central pivot point to allow pivoting between the legs; and a curved bar with an elastomeric cover secured with respect to the upper surface of the coupling member for being held by a user during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable stepladder which has all the advantages of the prior art stepladders of a wide variety of designs and configurations and none of the disadvantages.

It is another object of the present invention to provide a new and improved adjustable stepladder which may be easily and efficiently manufactured and marketed.

It is a further object of the present invention to provide a new and improved adjustable stepladder which is of a durable and reliable construction.

An even further object of the present invention is to provide a new and improved adjustable stepladder which is susceptible of a low cost of manufacture with regard to both materials and labor, and which accordingly is then susceptible of low prices of sale to the consuming public, thereby making such a adjustable stepladder economically available to the buying public.

Still yet another object of the present invention is to provide a new and improved adjustable stepladder which provides in the apparatuses and methods of the prior art some of the advantages thereof, while simultaneously overcoming some of the disadvantages normally associated therewith.

Even still another object of the present invention is to allow users to attain access to areas at varying heights while affording the user more safe, stable and comfortable footing.

Lastly, it is an object of the present invention to provide an adjustable stepladder comprising a front and rear leg assembly, each having a pair of parallel legs with coupling apertures at their upper ends and elastomeric stoppers at their lower ends, the leg assembly having a plurality of steps extending transversely between the legs with ends coupled to the legs at intermediate points along their lengths, each of the steps being fabricated with an elastomeric coating upon their upper surface, each of the legs being fabricated of a plurality of components with apertures and with the components coupled together in telescoping relationship with a locking pin positionable through alignable apertures in the areas of overlap and a spring interior thereof to hold the locking pin in a preset orientation, the areas of separation being provided beneath the lowermost step, above the uppermost step, and at regions between the steps; a coupling plate having a planar upper surface with an elastomeric sheet thereover with downwardly extending plates with apertures, the apertures adapted to be aligned with the apertures at the upper ends of the legs for effecting the pivotal coupling of the legs with respect to each other and the coupling plate; and a pivotable locking bar coupling the front leg assembly with the rear leg assembly, the locking bar having an aperture at one end pivotally couplable to one of the leg assemblies and having a plurality of apertures at the other end selectively couplable to an aperture of the other leg assembly as a function of the angle to be formed by the front leg assembly and rear leg assembly, the coupling bar also including a central pivot point to allow pivoting between the legs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
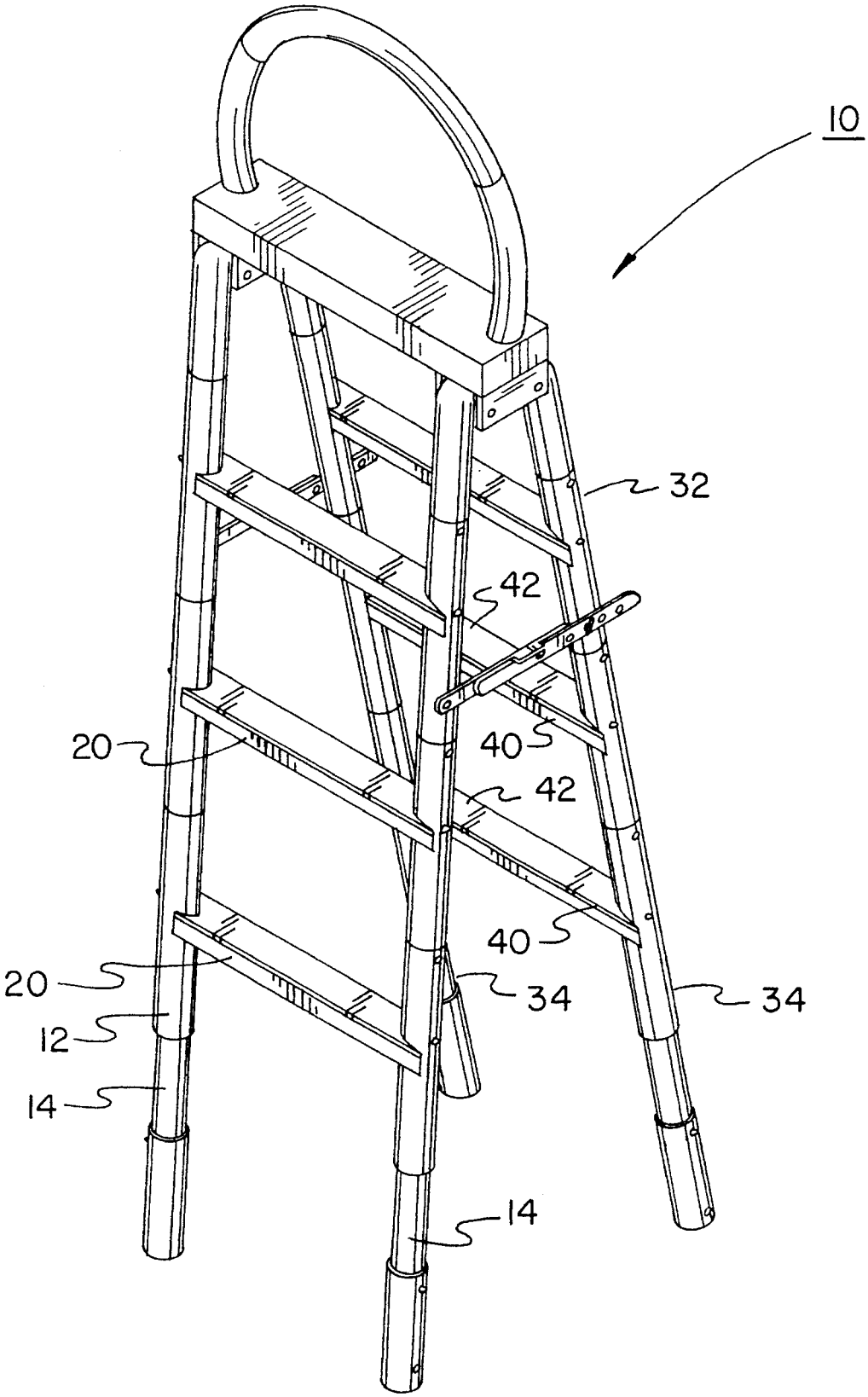
FIG. 1 is a perspective illustration of the preferred embodiment of the adjustable stepladder constructed in accordance with the principles of the present invention.
Figure 2:
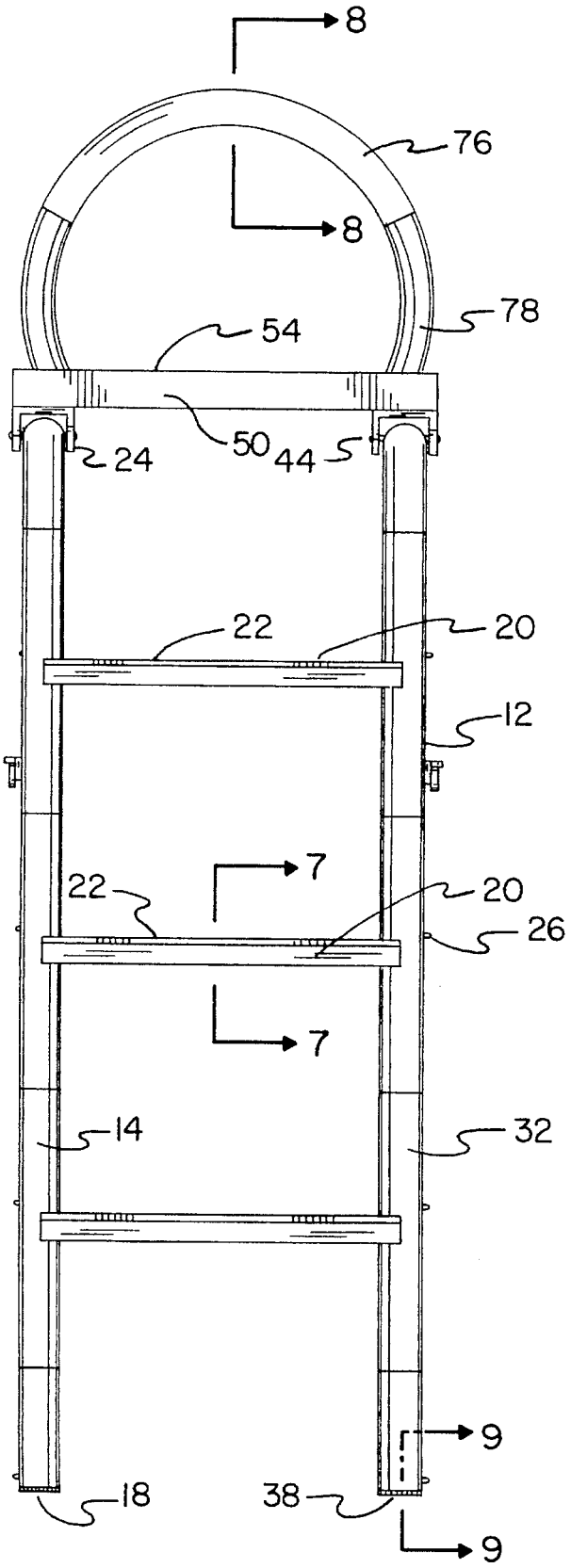
FIG. 2 is a front elevational view of the stepladder shown in FIG. 1.
Figure 3:
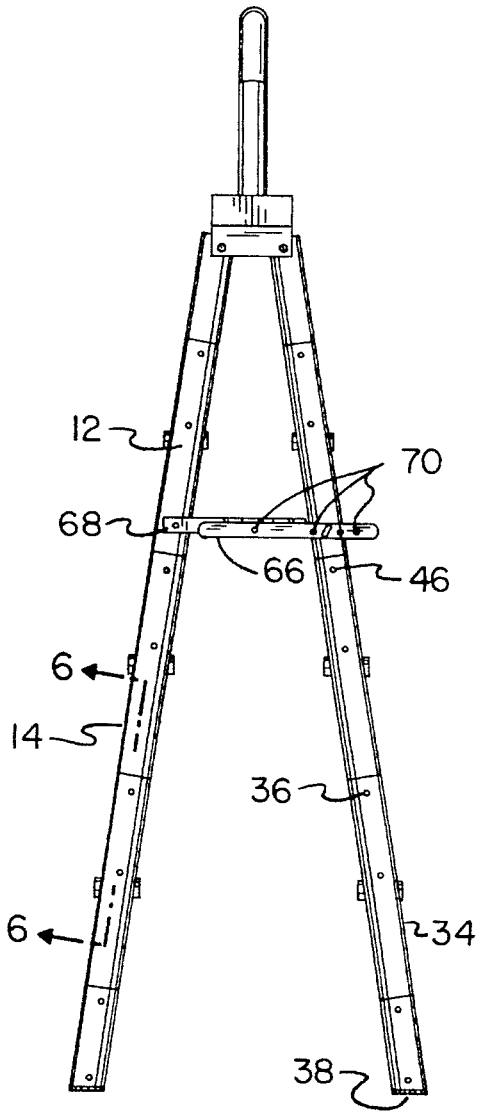
FIG. 3 is a side elevational view of the stepladder shown in FIGS. 1 and 2.
Figure 4:
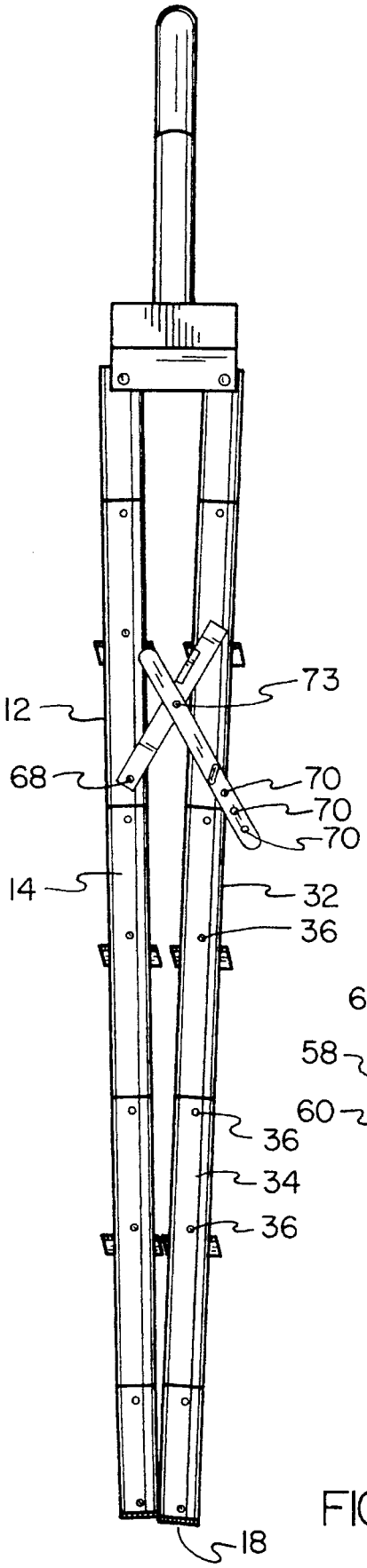
FIG. 4 is a side elevational view similar to FIG. 3 but illustrating the stepladder in the closed or storage orientation.
Figure 5:
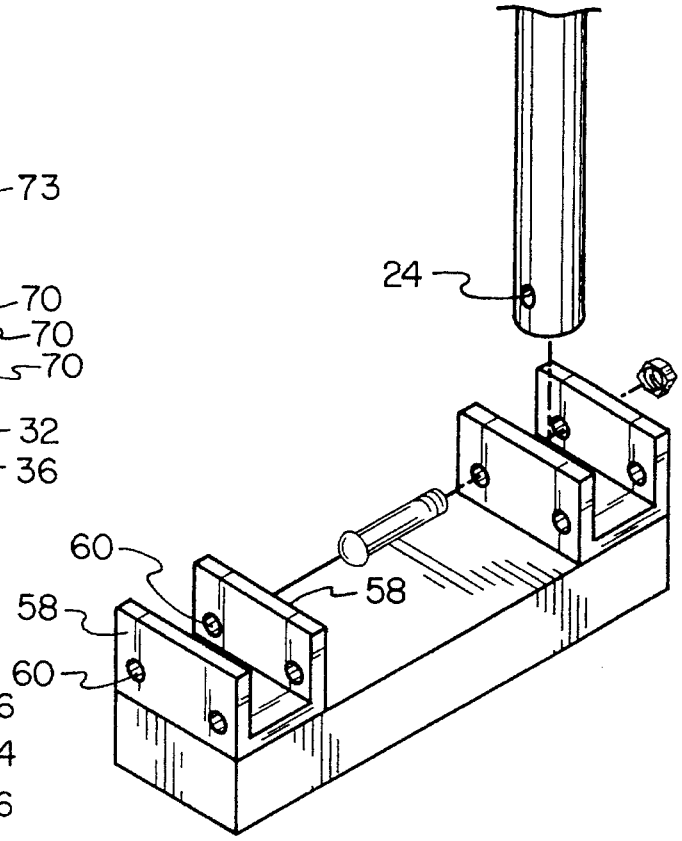
FIG. 5 is a perspective-view of the top coupling component of the ladder of the prior Figure.
Figure 6:
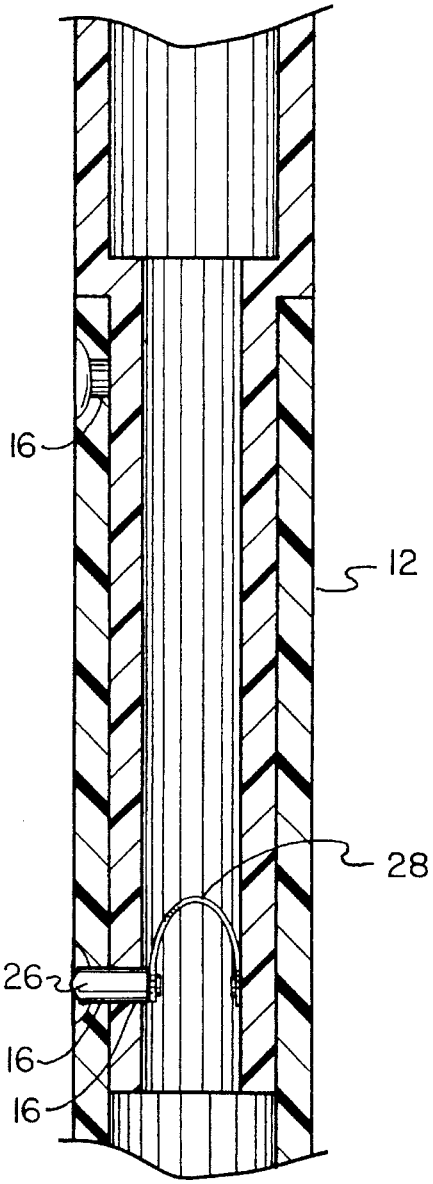
FIG. 6 is a cross-sectional view taken along line 6—6 of FIG. 3.
Figure 7:
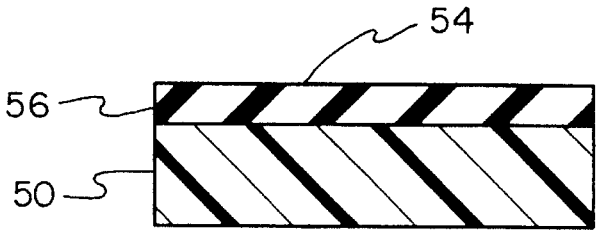
FIG. 7 is a cross-sectional view taken along line 7—7 of FIG. 2.
Figure 8:
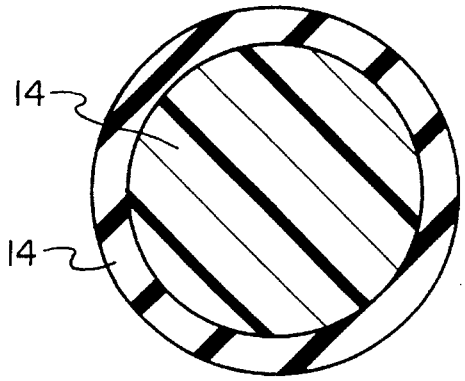
FIG. 8 is a cross-sectional view taken along line 8—8 of FIG. 2.
Figure 9:
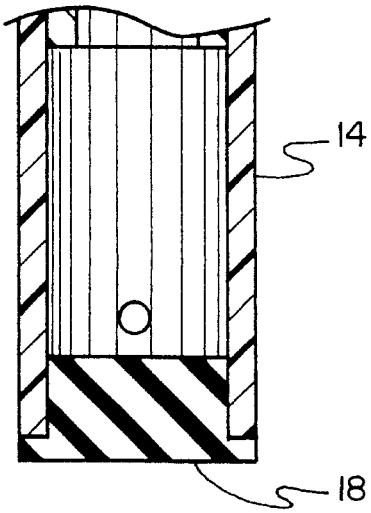
FIG. 9 is a cross-sectional view taken along line 9—9 of FIG. 2.

With reference now to the drawings, and in particular to FIGS. 1 through 9 thereof, the preferred embodiment of the new and improved adjustable stepladder embodying the principles and concepts of the present invention and generally designated by the reference numeral 10 will be described.

The present invention, the new and improved adjustable stepladder is a system 10 comprised of a plurality of components. Such components, in their broadest context, include a front leg assembly, a rear leg assembly, a coupling plate, a pivotal locking bar and a curved bar. Each of the individual components is specifically configured and correlated one with respect to the other so as to attain the desired objectives.

A central component of the system 10 of the present invention is the front leg assembly 12. Such front leg assembly has a pair of parallel legs 14. Coupling apertures 16 are located at their upper ends. Elastomeric stoppers 18 are at the lower ends of the legs.

The leg assembly 12 also has a plurality of steps 20. Such steps extend transversely between the legs with the ends of the steps coupled to the legs at intermediate points along the length of the legs. Each of the steps is fabricated with an elastomeric coating 22 upon their upper surface. This is to provide greater comfort and safety to the user. Each of the legs is fabricated of a plurality of components with apertures 24 and with the components coupled together in telescoping relationship. A locking pin 26 is positionable through aligned apertures in the areas of overlap. In addition, a spring 28 is located interior of the components. The spring functions to hold the locking pin in a preset orientation. Areas of separation are provided beneath the lowermost step, above the uppermost step and at regions between the steps.

The next major component of the system 10 is a rear leg assembly 32. The rear leg assembly also has a pair of parallel legs 34. Coupling apertures 36 are at the upper ends of the legs. In addition, elastomeric stoppers 38 are at the lower end of the leg.

The rear leg assembly has a plurality of steps 40 extending transversely between the legs. The ends of the steps are coupled to the legs at intermediate points along their lengths. Each of the steps is fabricated with an elastomeric coating 42 upon their upper surface for greater safety and comfort of a user.

Each of the legs is fabricated of a plurality of components with apertures 44 extending therethrough. The components are coupled together in telescoping relationship with a locking pin 46 positionable through aligned apertures in the area of overlap. In addition, a spring 48 interior of the components functions to hold the locking pin in a preset orientation. The area of separation between the steps is provided beneath the lowermost step, above the uppermost step, and at regions between the steps.

Next provided is a coupling plate 52. The coupling plate has a planar upper surface 54 with an elastomeric sheet 56 thereover. This is for improved comfort and safety of a user. In addition, downwardly extending plates 58 are provided with apertures 60. The apertures are adapted to be aligned with the apertures of the upper ends of the legs. This is for effecting the pivotal connecting of the legs with respect to each other and with respect to the coupling plate.

Coupling of the front leg assembly with the rear leg assembly is effected through a pivotable locking bar 66. Such locking bar has an aperture 68 at one end pivotally coupled to one of the leg assemblies. The locking bar also has a plurality of apertures 70 at the other end which is selectively couplable to an aperture of the other leg assembly. The selected aperture is a function of the angle to be formed by the front leg assembly and the rear leg assembly. The coupling bar also includes a central pivot point 72 to allow pivoting between the legs.

The last component of the system 10 is a curved bar 76. Such curved bar is provided with an elastomeric cover 78. The curved bar is secured with respect to the upper surface of the coupling member for being held by a user during operation and use of the ladder.

The present invention comprises a ladder which can be used to attain access to areas of varying heights and affords the user more stable, safer and more comfortable footing. It has four legs, each of which is made in two coaxially assembled and telescoping sections, and each leg is angled in a curved outboard direction for stability. The lower section of each leg can be extended or retracted and then locked in position in much the same fashion as the legs of a tripod, with markings to indicate how far a leg has been pulled out. The end of each leg is covered with a rubber cap. Each of the steps is faced with a special rubber padding which is textured to ensure non-skid footing. The frame of the ladder is made of a light but strong tubular steel, and the inverted U-shaped upper section serves as a stabilizing hand grip when required.

It is used in the same fashion as any conventional ladder, except that one has the capability to adjust the overall height as necessary to suit the job at hand. Each leg is simply unlocked and pulled down to the desired marking, where it is secure in place.

One can stand on the padded steps for longer periods of time without experiencing fatigue. The footing is positive, and the load is distributed across the entire foot to further enhance safety, for example, the conventional small rung need not be "wedged" into one local area of the foot. All of the legs need not be set at the same height, and one can adjust the ladder to accommodate uneven terrain outdoors or even articles within a room.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved adjustable stepladder comprising, in combination:

a front leg assembly having a pair of parallel legs with coupling apertures at their upper ends and elastomeric stoppers at their lower ends, the leg assembly being fabricated of tubular steel and having a plurality of steps extending transversely between the legs with ends coupled to the legs at intermediate points along their lengths, each of the steps being fabricated with an elastomeric coating upon their upper surface for greater comfort and safety of a user, each of the legs being fabricated of a plurality of components with apertures and with the components coupled together in telescoping relationship with a locking pin positionable through alignable apertures in the areas of overlap and a spring interior thereof to hold the locking pin in a preset orientation, the areas of separation being provided beneath the lowermost step, above the uppermost step, and at regions between the steps;

a rear leg assembly having a pair of parallel legs with coupling apertures at their upper ends and elastomeric stoppers at their lower ends, the leg assembly being fabricated of tubular steel and having a plurality of steps extending transversely between the legs with ends coupled to the legs at intermediate points along their lengths, each of the steps being fabricated with an elastomeric coating upon their upper surface for greater comfort of a user, each of the legs being fabricated of a plurality of components with apertures and with the components coupled together in telescoping relationship with a locking pin positionable through alignable apertures in the areas of overlap and a spring interior thereof to hold the locking pin in a preset orientation, the areas of separation being provided beneath the lowermost step, above the uppermost step, and at regions there between the steps, each leg of the front and rear leg assemblies being independently adjustable to accommodate uneven terrain;

a coupling plate having a planar upper surface with an elastomeric sheet thereover for improved comfort and safety and with downwardly extending plates with apertures, the apertures adapted to be aligned with the apertures at the upper ends of the legs for effecting the pivotal coupling of the legs with respect to each other and the coupling plate;

a pivotable locking bar coupling the front leg assembly with the rear leg assembly, the locking bar having an aperture at one end pivotally couplable to one of the leg assemblies and having a plurality of apertures at the other end selectively couplable to an aperture of the other leg assembly as a function of the angle to be formed by the front leg assembly and rear leg assembly, the coupling bar also including a central pivot point to allow pivoting between the legs; and a curved bar with an elastomeric cover secured with respect to the upper surface of the coupling member for being held by a user during operation and use.

* * * * *